US007685991B2

(12) United States Patent
Cumming et al.

(10) Patent No.: US 7,685,991 B2
(45) Date of Patent: Mar. 30, 2010

(54) ENGINE AND A METHOD OF MAKING SAME

(75) Inventors: Brian Cumming, Maldon (GB); Dave Ketcher, Chelmsford (GB)

(73) Assignee: Ford Global Technologies, LLC, Dearborn, MI (US)

( * ) Notice: Subject to any disclaimer, the term of this patent is extended or adjusted under 35 U.S.C. 154(b) by 469 days.

(21) Appl. No.: 11/036,250

(22) Filed: Jan. 14, 2005

(65) Prior Publication Data

US 2005/0161019 A1 Jul. 28, 2005

(30) Foreign Application Priority Data

Jan. 22, 2004 (GB) ..... 0401355.3

(51) Int. Cl.
*F02B 5/00* (2006.01)
*F02B 5/02* (2006.01)

(52) U.S. Cl. ..... 123/305

(58) Field of Classification Search ..... 123/193.1, 123/193.2, 196 V, 305, 196 M, 668, 298; 92/86.5, 162 R, 189, 259; 29/886.06
See application file for complete search history.

(56) References Cited

U.S. PATENT DOCUMENTS 2,071,062 A * 2/1937 Cummins ..... 123/298
3,961,104 A * 6/1976 Tanner ..... 427/198
4,258,084 A * 3/1981 Hayden, Sr. ..... 427/239
4,796,572 A * 1/1989 Heydrich ..... 123/41.42
4,987,865 A * 1/1991 Schenkel ..... 123/193.6
5,441,439 A * 8/1995 Grimm et al. ..... 451/28
5,570,668 A * 11/1996 Hsu ..... 123/193.2
5,630,953 A * 5/1997 Klink ..... 219/121.69
5,701,861 A * 12/1997 Hegemier et al. ..... 123/193.2
5,749,331 A * 5/1998 Pettersson et al. ..... 123/193.2
6,012,973 A * 1/2000 Nagel ..... 451/51
6,082,100 A * 7/2000 Boegner et al. ..... 60/278
6,158,407 A * 12/2000 Mizutani ..... 123/193.2
6,253,724 B1 * 7/2001 Han ..... 123/193.2
6,309,806 B1 * 10/2001 Lenthall et al. ..... 430/323
6,793,560 B2 * 9/2004 Weigmann et al. ..... 451/51
7,104,240 B1 * 9/2006 Vuk et al. ..... 123/193.2
7,191,770 B1 * 3/2007 Anderson et al. ..... 123/668
2002/0025386 A1 * 2/2002 Heinemann et al. ..... 427/446
2003/0056498 A1 3/2003 Kuenstler et al.

* cited by examiner

*Primary Examiner*—Mahmoud Gimie
(74) *Attorney, Agent, or Firm*—Julia Voutyras; Brooks Kushman P.C.

(57) ABSTRACT

An internal combustion engine 10 is provided with cylinders 19 having a predetermined surface finish thereon comprising of at least two differing patterns. The first pattern is designed to provide a predetermined storage volume for oil used to lubricate a piston 22 which is slidingly engaged in the cylinder 19. The second pattern is different to the first pattern in that it provides little or no storage capacity for the oil. The second pattern is applied to the wall 28 of each cylinder 19 at one or more positions where impingement of unburned fuel against the cylinder wall 28 is to be expected. The reduced storage volume of the second pattern reduces the volume of unburned fuel that can be transferred from the cylinder 19 to the oil supply of the engine 10.

1 Claim, 3 Drawing Sheets

ENGINE AND A METHOD OF MAKING SAME

FIELD OF THE INVENTION

This invention relates to internal combustion engines and in particular to the manufacture of an internal combustion engine.

BACKGROUND

It is known that it is necessary to have a certain degree of roughness on each cylinder wall of an engine to retain oil used as a lubricant between the cylinder wall and the piston which is slidingly engaged within the respective cylinder. In practice, the surface of the cylinder wall comprises a number of peaks and troughs and the oil is stored within the troughs. It is further well known in the manufacture of internal combustion engines to use a honing process to produce a desired surface finish on the wall of each cylinder of the engine to provide such an oil retention surface.

In recent years there has been an increased demand for the use of emission control devices on all engines used for automotive vehicles. In the case of spark ignition engines the use of NOx traps is becoming more common and in the case of diesel engines the use of a particulate filter and in some cases a NOx trap is becoming increasingly a requirement.

There is a requirement to periodically regenerate any particulate filter or NOx trap fitted to such an engine to maintain the efficiency of the particulate filter or NOx trap.

In the case of diesel engines, regeneration can be brought about by late or post-injection of fuel into each cylinder. U.S. Patent application 2003/0056498-A1 provides an example of a method and device for regenerating a particulate filter used with a diesel engine.

It is also a requirement to regenerate an emission device of a spark ignited engine and in so doing it is a possibility that some unburned fuel may contact the cylinder walls and may result in the fuel contaminating the lubrication oil.

There are other situations in which unburned fuel may collect on the cylinder walls such as pilot injection or when multiple injections are used.

In any of these cases it is a problem that some of the fuel injected into each cylinder for regeneration purposes remains within the troughs in the surface of each cylinder wall and is subsequently transferred past the piston rings to the oil used to lubricate the engine.

The addition of this fuel to the oil can produce problems and, in particular, can lead to a reduction in oil viscosity with a consequential reduction in oil lubrication performance.

It is an object of this invention to provide an engine with less susceptibility to fuel to oil transfer and to provide a method for manufacturing such an engine.

SUMMARY OF THE INVENTION

According to a first aspect of the invention, there is provided an internal combustion engine having at least one cylinder for slidingly supporting a piston, the cylinder wall of the at least one cylinder of the engine being manufactured to provide at least one predetermined region having a low liquid storage volume so as to reduce oil contamination by fuel transfer past the piston. The at least one predetermined region is positioned within the respective cylinder in which fuel injected into the cylinder which is not combusted by the engine will contact the cylinder wall.

The cylinder wall of the at least one cylinder of the engine may have a first surface pattern formed thereon for retaining a volume of liquid and the at least one predetermined region of the respective cylinder wall is provided with a different pattern having a reduced liquid storage capacity compared to the liquid storage capacity of the first pattern.

The engine may further comprise a reservoir for storing a supply of engine oil and the at least one predetermined region of the respective cylinder reduces the transfer of fuel from the respective cylinder to the reservoir.

The first surface pattern may comprise a pattern of peaks and troughs formed by a honing process to produce a predetermined liquid storage volume per unit area of cylinder wall.

The first surface pattern may comprise a relatively smooth surface finish having a plurality of grooves formed therein forming a lattice structure for the retention of a predetermined volume of liquid per unit area of cylinder wall.

The first surface pattern may comprise a relatively smooth surface finish having a plurality of discrete pockets formed therein for the retention of a predetermined volume of liquid per unit area of cylinder wall.

The predetermined region may comprise a band extending circumferentially around the cylinder wall.

The different surface pattern may comprises a relatively smooth surface finish having a plurality of discrete pockets formed therein wherein the average liquid storage volume of the discrete pockets per unit area of the second pattern is considerable less than the average liquid storage volume per unit area of the first pattern.

Preferably, the predetermined region may comprise a number of circumferentially spaced regions.

The different pattern within each of the predetermined regions may comprise a smooth surface finish.

The different pattern within each of the predetermined regions may comprise a relatively smooth surface finish having a plurality of discrete pockets formed therein wherein there are less discrete pockets per unit area than are present in the first pattern so that the liquid storage capacity per unit area of the pattern within each of the predetermined regions is less than the liquid storage capacity per unit area of the first pattern.

The different pattern within each of the predetermined regions may comprise a relatively smooth surface finish having a plurality of discrete pockets formed therein wherein each discrete pocket has a smaller volume than the volume of a corresponding pocket used in the first pattern so that the liquid storage capacity per unit area of the pattern within each of the predetermined regions is less than the liquid storage capacity per unit area of the first pattern.

The engine may be a diesel engine adapted to provide late injection of fuel into at least one cylinder of the engine for regenerating an emission control device and the at least one predetermined region is positioned such that the late injection of fuel into the cylinder impinges against the cylinder wall within the at least one predetermined region.

Each cylinder of the engine may be provided with a fuel injector nozzle providing one or more divergent fuel jets and there are a like number of predetermined regions within each cylinder as there are jets of injected fuel.

According to one embodiment, the engine is adapted to provide for the late injection of fuel into all cylinders of the engine.

According to another embodiment, the engine is adapted to provide one of early or late injection of fuel into at least one cylinder of the engine so as to bring unburned fuel into contact with a cylinder wall of the engine.

According to another aspect of the invention there is provided a method of manufacturing a cylinder for an internal combustion engine, the method including producing a cylinder wall with a required diameter and roundness and machining the cylinder wall to provide at least one predetermined region having a low liquid storage volume so as to reduce, in use, oil contamination by fuel transfer past a piston slidingly engaged with the cylinder. The at least one region is located on the cylinder wall such that, in use, any fuel injected into the cylinder which is not combusted by the engine will contact the cylinder wall substantially within the at least one region.

The method includes applying a first pattern to the wall of the cylinder for retaining, in use, a volume of liquid and applying a second pattern to the cylinder wall in at least one region of the cylinder wherein the second pattern has a reduced liquid storage capacity compared to the first pattern.

In one alternative, the first pattern is applied by honing. In another alternative, the first pattern has a relatively smooth surface having a plurality of discrete pockets formed by laser machining for the retention of liquid.

In yet another embodiment, the second pattern has a relatively smooth surface. Alternatively, the second pattern has a relatively smooth surface having a plurality of discrete pockets formed by laser machining for the retention of liquid.

In one embodiment, the number of pockets per unit area in the second pattern is less than the number of pockets per unit area in the first pattern so that the liquid storage capacity per unit area of the second pattern is less than the liquid storage capacity of the first pattern. In another embodiment, the volume of the pockets in the second pattern is smaller than the volume of the pockets in the first pattern so that the liquid storage capacity per unit area of the second pattern is less than the liquid storage capacity of the first pattern.

Preferably, there are a number of circumferentially spaced regions each of which has the second pattern formed therein.

BRIEF DESCRIPTION OF THE DRAWINGS

The invention will now be described by way of example with reference to the accompanying drawing of which.

DETAILED DESCRIPTION

Figure 1:
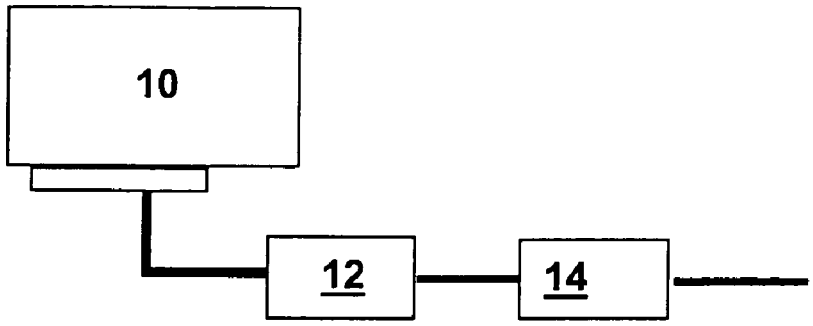
FIG. 1 is a schematic diagram of a diesel engine and exhaust system according to the invention.

With reference to FIG. 1 there is shown a multi-cylinder diesel internal combustion engine 10 the exhaust gases from which are fed to a NOx trap 12 and then to a particulate filter 14. The engine 10 is in most respects conventional in nature and is connected to a fuel tank (not shown) holding a supply of fuel to be combusted and has an oil reservoir such as a sump (not shown) for storing a supply of oil used to lubricate moving parts of the engine 10.

The engine 10 is adapted to provide for regenerating the particulate filter 14 and the NOx trap 12 by arranging for the late injection of fuel into each cylinder of the engine 10 when regeneration is indicated to be necessary. This late injection of fuel has the effect of providing a quantity of unburned fuel to the NOx trap which acts as a reductant for the material stored in the trap 12 and also, under different conditions, causes spontaneous ignition within the trap 12 thereby producing hot gases which pass to the filter 14 and burn off products of combustion stored in this device.

Figure 2:
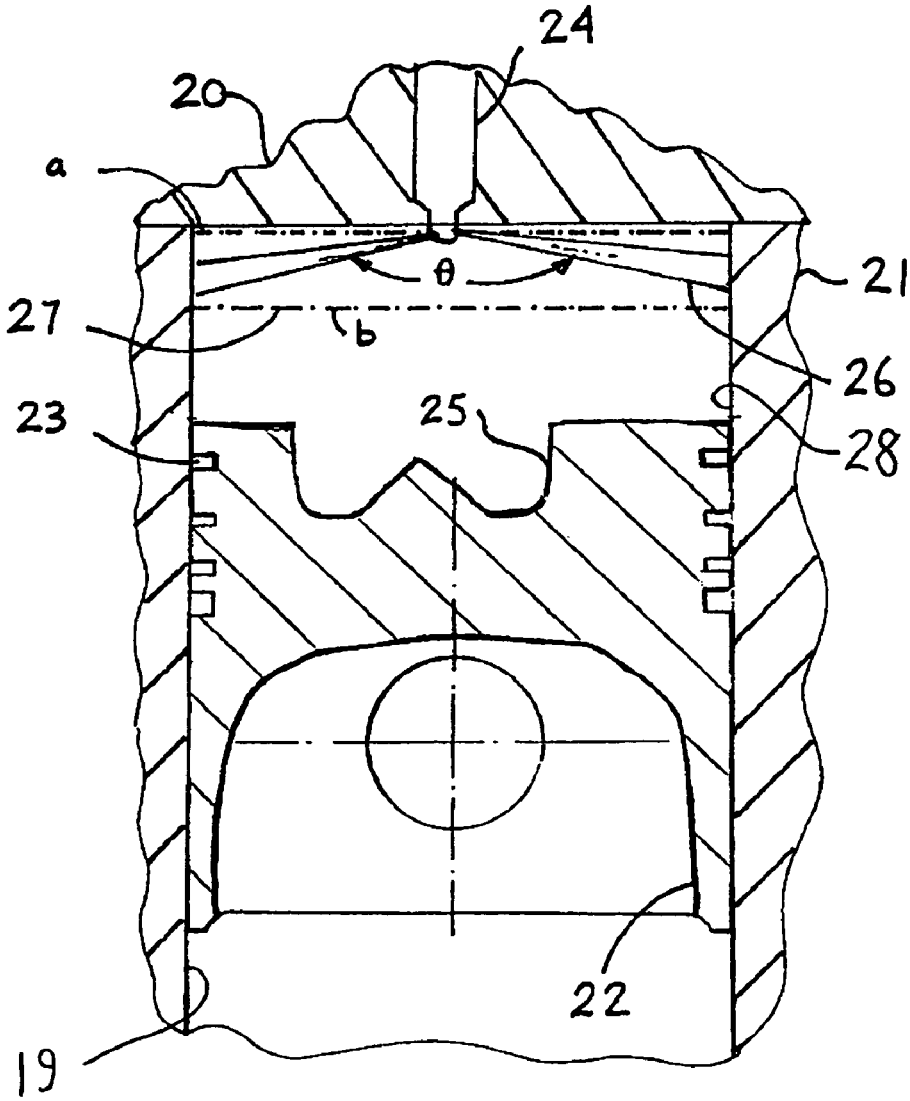
FIG. 2 is a cross-section through one cylinder of the engine shown in FIG. 1 showing late injection of fuel into the cylinder for emission component regeneration.

With reference to FIG. 2 there is shown one cylinder 19 formed within a cylinder block 21 of the engine 10. A piston 22 is slidingly supported by the cylinder 19 and has a number of piston rings 23 to provide a seal between the piston 22 and the cylinder 19.

A cylinder head 20 is attached to the cylinder block 21 by fasteners (not shown) to close of the upper end of the cylinder 19 and support a number of valves (not shown) to selectively admit air into the cylinder 19 and to selectively allow exhaust gases to flow from the cylinder 19 to the NOx trap 12 and the particulate filter 14.

A fuel injector nozzle 24 is supported by the cylinder head 20 for injecting fuel into the cylinder 19. The fuel injector nozzle 24 provides a number of divergent fuel jets 26 each of which is directed outwardly from the fuel injector nozzle 24. Each of the jets 26 comprises a stream of fuel droplets of small size, which during normal use are largely contained within a combustion chamber 25 formed in the piston 22.

In the case of late or delayed injection, the piston 22 has already started to move downwardly in the power stroke of the engine 10 and, in this case, the fuel jets 26 impinge directly against the wall 28 of the cylinder 19, as is shown in FIG. 2. There are four fuel jets 26 issuing from the injector nozzle 24 but only two of these are visible on FIG. 2. It will however be appreciated by those skilled in the art that there could be a greater or lesser number of jets rather than just four.

The wall 28 of the cylinder 19 is provided with a first pattern for retaining a pre-determined volume of oil required for the lubrication of the piston 22 and the piston rings 23 as the piston 22 moves in the cylinder 19. This first pattern can be of many differing forms such as, for example, it can be a honed surface having a number of peaks and troughs in which the troughs form a storage volume for the oil, it can be a lattice structure of grooves formed in an otherwise smooth surface or, as shown in FIG. 3, it can be in the form of a smooth surface in which a plurality of discrete pockets 30 have been formed by laser machining.

The term pattern as meant herein means any surface feature and includes areas in which oil can be retained and areas in which substantially no oil can be retained.

Figure 3:
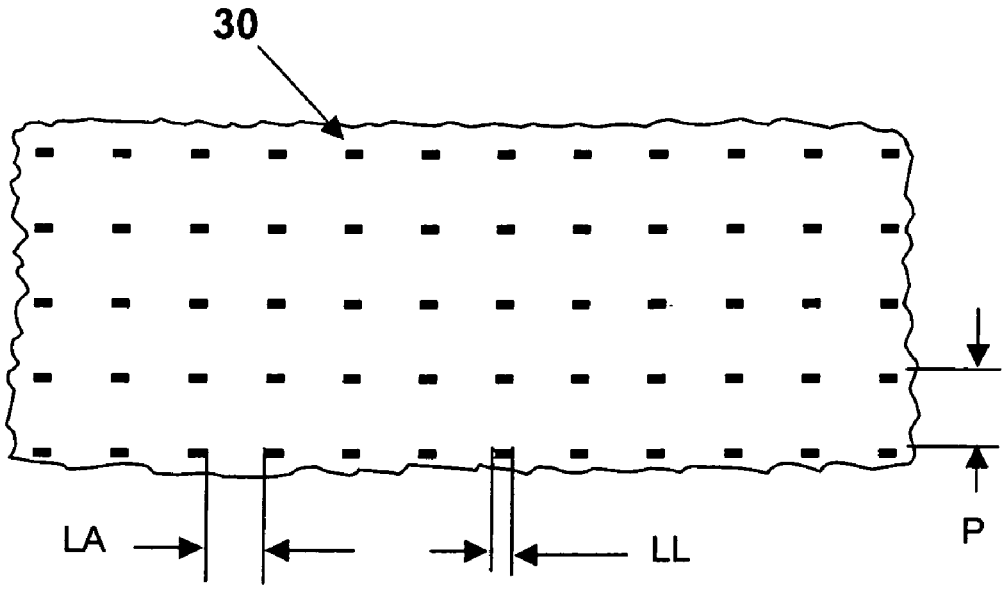
FIG. 3 is a view of portion of the cylinder wall of the cylinder shown in FIG. 2 showing a first pattern of oil retention pockets.

In the case of the embodiment shown in FIG. 3, the first pattern is in the form of a number of regularly spaced rectangular pockets 30. In a typical pattern, each pocket has a length 'LL' of approximately 3 mm, a depth of approximately 15 to 20 μm, and a width of approximately 40 to 50 μm. The distance 'LA' between adjacent pockets 30 is approximately 2 mm and the pitch 'P' of adjacent rows of pockets 30 is approximately 3 mm. Surrounding each pocket is a smooth area having a surface texture of approximately 0.05 to 0.2 μm RA. RA is a measurement of the average distance between the median line of the surface profile and its peaks and troughs as set down in British Standard BS1134. However, it will be appreciated that these dimensions are provided by way of example and that alternative dimensions could be used for different applications.

The first pattern is formed generally over the wall of the cylinder 19 so as to provide a source of lubrication for the piston 22.

To reduce the transfer of fuel into the oil an alternative pattern is used within a predetermined region of the cylinder wall 28. Various patterns can be used; but in each case, the volume of oil that can be stored per unit area of cylinder wall 28 is much lower than that for the first pattern described above.

In a first embodiment of the invention, the predetermined region is in the form of a single circumferentially extending band 27 having an upper edge 'a' and a lower edge 'b'. Within this band 27, a different pattern is used to that used on other parts of the cylinder wall 28.

This different pattern can be of any suitable form; but in all cases, the average liquid storage capacity of the pattern per unit area of cylinder wall 28 is much lower than that for the first pattern.

In this embodiment, the different pattern (not shown) is formed by laser machining discrete pockets into the cylinder wall 28 within the band 27 which have less liquid storage capacity per unit area of cylinder wall 28 than the liquid storage capacity of the discrete pockets 30 forming the first pattern.

The positioning of the band 27 is chosen so that any unburned fuel coming into contact with the cylinder wall 28 is likely to contact the cylinder wall within the band 27. In particular the band 27 is positioned such that the position of impingement of the fuel jets 26 against the cylinder wall 28 falls within the boundaries of the band 27. In the example shown the included angle, θ, between the centerlines of each the two fuel jets 26 is approximately 155° and this angle can be used to calculate the positioning of the band 27 allowing for spread or dispersion of the jets 26. It will be appreciated that the width of the band 27 is greater than the width of each jet 26 where it impinges upon the cylinder wall 28 to ensure that almost all of the fuel contacting the cylinder wall 28 does so within the band 27. This ensures that the minimum amount of transfer of fuel into the oil will occur as the amount of fuel that can be retained on the cylinder wall 28 is at a minimum.

Figure 4:
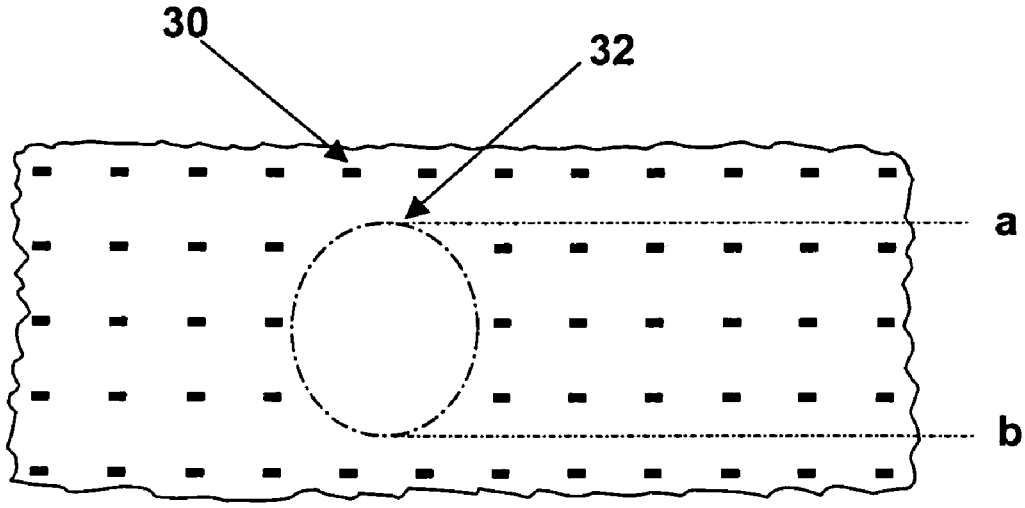
FIG. 4 is a view similar to FIG. 3 but showing a different pattern of oil retention pockets.

Referring now to FIG. 4, there is shown a second embodiment of the invention in which instead of a single predetermined region there are a number of circumferentially spaced regions 32 within each of which a different pattern to the first pattern is used. There are a like number of circumferentially spaced regions 32 as there are fuel jets 26.

Each of these regions 32 is surrounded by the first pattern and is positioned on the cylinder wall 28 such that one of the fuel jets 26 issuing from the injector nozzle 24 impinges against the cylinder wall 28 within the boundary of the region 32. The dimensions of each region 32 is sufficient that substantially all of any unburned fuel coming into contact with the cylinder wall 28 does so within the boundary of one of the regions 32. As before, the liquid storage capacity per unit area of the pattern used within each of the circumferentially spaced regions 32 is much lower than that used for the first pattern. The circumferentially spaced regions 32 are positioned vertically on the cylinder wall 28 in a similar position to that of the band 27 previously referred to as indicated by the superimposed upper and lower edges 'a' and 'b' of the band 27 on FIG. 4. It will be appreciated that the shape of each of the circumferentially shaped regions 32 need not be a uniform or regular shape but could be chosen to suit the fuel dispersion pattern of the particular engine.

In the case of the embodiment shown in FIG. 4 there is substantially no available storage volume within each of the circumferentially spaced regions 32 because the pattern comprises simply of a smooth surface finish having a surface texture of 0.05 to 0.2 μm RA which provides for very little oil storage volume, but is sufficiently coarse to allow the oil to wet the cylinder wall 28. The first pattern can be of any suitable form but in this case is the same as that previously described with reference to FIG. 3.

Figure 5:
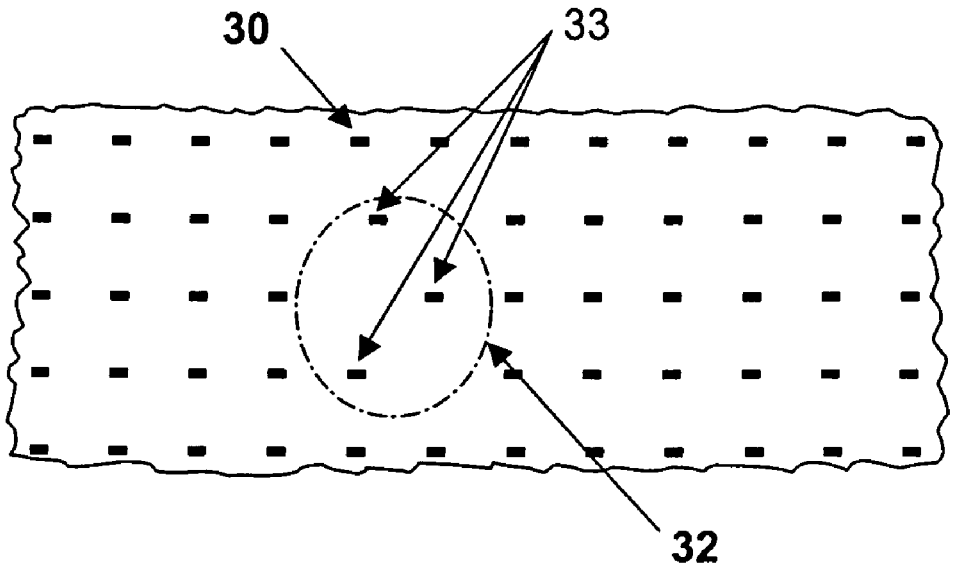
FIG. 5 is a view similar to FIG. 4 but showing a further pattern of oil retention pockets.

Referring now to FIG. 5, there is shown a third embodiment of the invention, which is similar to the second embodiment in that a number of circumferentially spaced regions 32 having a different pattern to the first pattern are used. Each of these regions 32 is as before surrounded by the first pattern and is positioned on the cylinder wall 28 such that the fuel jets 26 issuing from the injector nozzle 24 impinge against the cylinder wall 28 within the boundary of the region 32. As before the liquid storage capacity per unit area of the pattern used within each of the circumferentially spaced regions 32 is much lower than that used for the first pattern.

In the case of the third embodiment shown in FIG. 5, there is more liquid or oil storage volume than that shown in FIG. 4, but much less than that for the surrounding first pattern. In this embodiment, the different pattern has a smooth surface finish having a surface texture of 0.05 to 0.2 μm RA in which a small number of discrete pockets 33 have been formed. In this case, the dimensions of each of the pockets 33, within each of the circumferentially spaced regions 32, is the same size as one of the pockets 30 in the first pattern; but, there are less pockets 33 per unit area in the pattern used within the circumferentially spaced regions 32 than in the first pattern. As shown, there are half as many pockets 33 used per unit area for the pattern used in the circumferentially spaced regions 32 compared to the first pattern but other ratios could be used. Once again, the first pattern can be of any suitable form; but, in this case is the same as that previously described with reference to FIG. 3.

Figure 6:
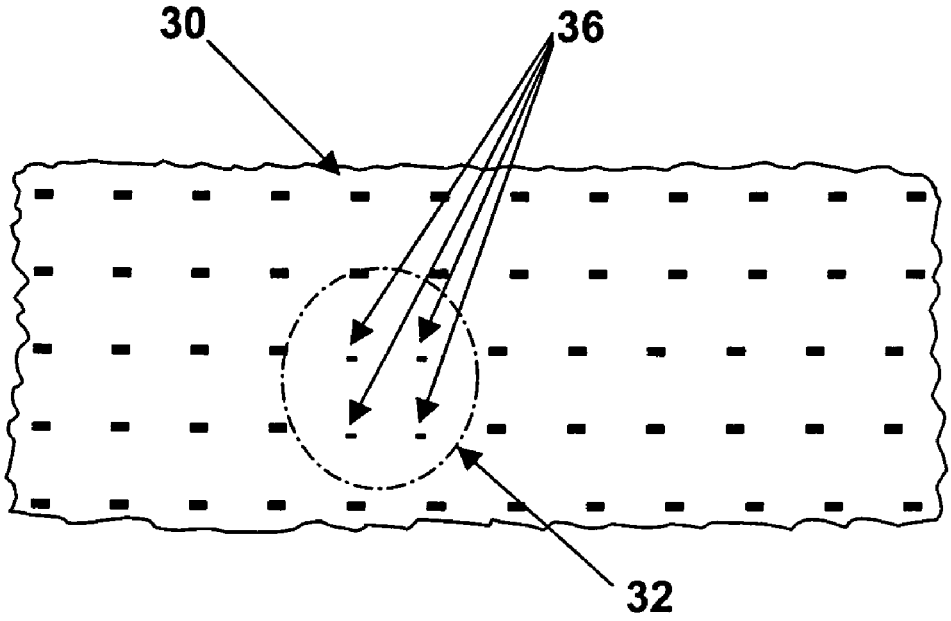
FIG. 6 is a view similar to FIG. 4 but showing yet one more pattern of oil retention pockets.

With reference to FIG. 6, there is shown a fourth embodiment of the invention which in many respects is the same as that previously described with reference to FIG. 5. But instead of reducing the number of pockets per unit area to reduce the liquid storage capacity, the size of each pocket is reduced so that the pockets 36 within each of the circumferentially spaced regions 32 is approximately half the width and half as long as the pockets 30 used in the first pattern, but the number of pockets 36 per unit area is the same as for the first pattern.

It will be appreciated that various other combinations of pocket size or number of pockets per unit area could be used to provide a similar effect and the second or different pattern could use a combination of both size and quantity of pockets to reduce the liquid storage capacity for example only half the number of pockets per unit area could be used and each of the pockets could have a storage volume that is 50% of one of the pockets used in the first pattern.

It will also be appreciated that the first pattern may not have any pockets. It could, for example, be a machined or honed surface having sufficient surface texture to store sufficient oil for lubrication purposes and the second pattern is provided in pre-determined areas in which the pockets are formed into an otherwise very smooth surface unable to retain sufficient oil for lubrication purposes, but having sufficient surface texture to permit the oil to wet the surface. In this case, the size and frequency of the pockets in the second pattern is that providing minimum liquid storage capacity to reduce fuel transfer to the oil, but having sufficient oil storage capacity to provide minimum lubrication for the piston.

Therefore in summary, the inventors have realized that it is a problem with any engine where unburned fuel contacts the cylinder walls that the fuel can contaminate the oil used to lubricate the engine and have proposed a solution to this problem by using an engine in which one or more specific regions of the wall of each affected cylinder where fuel is likely to contact the cylinder wall is manufactured with a greatly reduced capacity for storing liquid than would normally be provided in order to lubricate the cylinder. Therefore because less liquid can be stored in these regions less fuel is subsequently transferred into the oil supply.

Although it is possible to manufacture such an engine in many ways using for example the honing of different parts of the cylinder to produce different surface finishes it is preferred to use a laser machining process to produce discrete pockets in an otherwise smooth surface. This is because such a laser machining process allows the liquid storage capacity to be accurately controlled because laser machining allows each pocket to be accurately produced and also the use of laser machining permits considerable flexibility in the location size, shape and orientation of the various pockets.

In accordance with a first embodiment of such a method an engine block is produced having a number of cylinders. Each of the cylinders is machined to produce a cylinder wall having the required diameter, roundness and desired smooth surface texture. A number of discrete pockets are then machined into the cylinder wall using a laser machining process to provide liquid retention means which in use will retain oil for lubrication purposes.

For most uses the smooth surface has a surface texture of 0.05 to 0.2 μm RA which provides for very little oil storage volume but is sufficiently coarse to allow the oil to wet the cylinder wall.

In order to provide the engine with good lubrication while reducing the risk of fuel transfer into the oil, the pockets are not machined uniformly into the cylinder wall but are instead machined such that regions where contact between fuel and the cylinder wall is likely to occur have a greatly reduced liquid storage capacity. This can be done in various ways such as reducing the size of the pockets machined into these regions, changing the shape of the pockets, changing the orientation of the pockets, by reducing the number of pockets formed into these regions or by some combination of these.

Therefore in greater detail a preferred method comprises producing each cylinder wall with a required diameter and roundness, applying a first pattern of discrete pockets to the wall of each cylinder for retaining in use a volume of liquid and applying a second pattern to the cylinder wall in at least one region of the cylinder having a reduced liquid storage capacity compared to the first pattern.

The second pattern may comprise of simply a smooth surface, that is to say in each region there is no extra machining performed, but preferably it comprises of a relatively smooth surface in which a plurality of discrete pockets are formed therein by laser machining. The number of pockets per unit area in the second pattern is less than the number of pockets per unit area in the first pattern so that the liquid storage capacity per unit area of the second pattern is less than the liquid storage capacity of the first pattern. Alternatively, the volume of each of the pockets in the second pattern can be made smaller than the volume of each of the pockets in the first pattern while retaining the same number of pockets per unit area so that the liquid storage capacity per unit area of the second pattern is less than the liquid storage capacity of the first pattern.

Preferably the second pattern is provided in a number of circumferentially spaced regions which are laser machined into the cylinder wall at positions corresponding to the positions where fuel is expected to contact the cylinder wall when the engine is in use.

That is to say, any fuel injected into the cylinder which is not combusted by the engine will contact the cylinder wall substantially within the circumferentially spaced regions. In addition, each of the circumferentially spaced regions is located so as to include the position at which fuel injected into the cylinder which is not combusted by the engine directly impinges against the cylinder wall. It will be appreciated that during injection of fuel there may be a spreading of fuel away from the actual point of direct or initial impingement between the fuel jets and the cylinder wall and that the fuel jets may be disturbed by air patterns within the cylinder.

The number of regions corresponds to the number of fuel jets used to inject fuel into the cylinder in use and the position of each region can be estimated based upon the design dimensions of the engine and the design of the fuel injector used for the injection of fuel.

By using such a combination of small regions having low liquid storage potential within an area having good oil storage potential the lubrication of the engine is not compromised but the amount of fuel transferred into the oil is considerably reduced.

As an alternative to the above method the engine may be manufactured by producing each cylinder wall with a required diameter and roundness, applying a first pattern by a honing process to the wall of the cylinder for retaining in use a volume of liquid and applying a second pattern to the cylinder wall in one region of the cylinder having a reduced liquid storage capacity compared to the first pattern. The second pattern comprises of a smooth surface in which a number of pockets are formed therein by laser machining. In this case the honed area of the cylinder wall provides a relatively large liquid storage capacity to ensure adequate lubrication of the engine and the number or size of the pockets forming with the smooth surface the second pattern provide a greatly reduced liquid storage volume. As before the positioning of the second pattern is chosen so as to correspond with positions on the cylinder wall where unburned fuel is anticipated to contact the cylinder wall. In this case the region in which the second pattern is formed takes the form of a continuous band extending around the cylinder wall in which a number of pockets are formed. The distribution of pockets may or may not be uniform. So that, for example, there may be portions of the band with virtually no pockets in areas where fuel impingement is highly likely and there are other portions which have more pockets to provide oil storage capacity for lubrication purposes. Alternatively, the whole band may be produced with a number of evenly spaced pockets having an average liquid storage capacity that is much less than that normally provided for lubrication of the engine.

It will be appreciated by those skilled in the art that although the invention has been described by way of example with reference to a number of specific embodiments it is not limited to these embodiments and that various alternative embodiments or modifications to the disclosed embodiments could be made without departing from the scope of the invention. For example although the invention has been described with reference to an engine in which the cylinder walls are machined directly into the cylinder block it will be appreciated that the invention is equally applicable to an engine using cylinder liners.

We claim:

1. An internal combustion engine having at least one cylinder for slidingly supporting a piston, wherein the cylinder wall of the at least one cylinder of the engine is manufactured to provide a first surface pattern formed thereon for retaining a volume of liquid and a plurality of circumferentially spaced regions having a different pattern with a reduced liquid storage capacity compared to the liquid storage capacity of the first pattern to reduce dilution of lubricating oil with fuel retained in the cylinder, wherein the engine is a diesel engine adapted to provide late injection of fuel into the at least one cylinder of the engine for regenerating an emission control device, said plurality of regions being positioned such that said late injection of fuel into the cylinder impinges against the cylinder wall substantially within said plurality of regions, wherein each cylinder of the engine is provided with a fuel injector nozzle providing a plurality of divergent fuel jets, and wherein the plurality of regions within each cylinder corresponds to the number of divergent fuel jets.

* * * * *